US009052088B2

(12) United States Patent
Smith

(10) Patent No.: US 9,052,088 B2
(45) Date of Patent: Jun. 9, 2015

(54) TUNED COMPOSITE OPTICAL ARRANGEMENT FOR LED ARRAY

(71) Applicant: Whelen Engineering Company, Inc., Chester, CT (US)

(72) Inventor: Todd J. Smith, Deep River, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 78 days.

(21) Appl. No.: 14/033,115

(22) Filed: Sep. 20, 2013

(65) Prior Publication Data

US 2015/0085479 A1 Mar. 26, 2015

(51) Int. Cl.

| | |
|---|---|
| ***F21V 1/00*** | (2006.01) |
| ***F21V 7/06*** | (2006.01) |
| ***F21V 7/00*** | (2006.01) |

(52) U.S. Cl.
CPC .. *F21V 7/06* (2013.01); *F21V 7/005* (2013.01)

(58) Field of Classification Search
CPC ..... F21V 7/06; F21V 7/005
USPC ..... 362/217.06, 217.05
See application file for complete search history.

(56) References Cited

U.S. PATENT DOCUMENTS

| | | | | |
|---|---|---|---|---|
| 1,235,275 | A | 7/1917 | Wood | |
| 6,471,375 | B2 | 10/2002 | Kobayashi et al. | |
| 6,641,284 | B2 | 11/2003 | Stopa et al. | |
| 6,644,841 | B2 | 11/2003 | Martineau | |
| 6,739,738 | B1 | 5/2004 | Smith | |
| 6,758,582 | B1 | 7/2004 | Hsiao et al. | |
| 6,851,835 | B2 | 2/2005 | Smith et al. | |
| 7,008,079 | B2 | 3/2006 | Smith | |
| 7,083,313 | B2 | 8/2006 | Smith | |
| 7,175,303 | B2 | 2/2007 | Kovacik et al. | |
| 7,461,944 | B2 | 12/2008 | Alessio | |
| 7,520,650 | B2 | 4/2009 | Smith | |
| 7,690,826 | B2 | 4/2010 | Kim | |
| 7,959,322 | B2 | 6/2011 | Smith | |
| 2001/0022725 | A1 | 9/2001 | Kobayashi et al. | |
| 2007/0242461 | A1 | 10/2007 | Reisenauer et al. | |
| 2008/0165535 | A1 | 7/2008 | Mazzochette | |
| 2009/0168395 | A1 * | 7/2009 | Mrakovich et al. | 362/84 |
| 2010/0110677 | A1 | 5/2010 | Stein | |
| 2012/0327655 | A1 * | 12/2012 | Li | 362/235 |
| 2013/0235580 | A1 | 9/2013 | Smith | |
| 2013/0279159 | A1 * | 10/2013 | Pickard et al. | 362/218 |
| 2013/0306998 | A1 * | 11/2013 | Ulasyuk | 257/88 |

FOREIGN PATENT DOCUMENTS

| | | | |
|---|---|---|---|
| WO | 2006020687 | A1 | 2/2006 |

OTHER PUBLICATIONS

European Search Report dated Nov. 14, 2014 (EP Application No. 14185145.1).

* cited by examiner

*Primary Examiner* — Evan Dzierzynski
(74) *Attorney, Agent, or Firm* — Alix, Yale & Ristas, LLP

(57) ABSTRACT

An LED optical assembly includes a linear array of LEDs, longitudinal reflecting surfaces along each side of the array and medial reflecting surfaces between the LEDs. The longitudinal reflecting surfaces include surfaces of rotation centered on the optical axis of each LED interspersed with linear reflecting portions defined by curves projected along a linear focal axis of the assembly.

9 Claims, 9 Drawing Sheets

TUNED COMPOSITE OPTICAL ARRANGEMENT FOR LED ARRAY

BACKGROUND

The present disclosure relates generally to warning light devices, and more particularly to optical configurations for producing integrated directional light from a LED light sources.

While not limited thereto in its utility, the novel technology to be described below is particularly well suited for use in combination with light emitting diodes (LED's) and, especially, for use in warning and signaling lights.

Commercially available LED's have characteristic spatial radiation patterns with respect to an optical axis which passes through the light emitting die. A common characteristic of LED radiation patterns is that light is emitted in a pattern surrounding the optical axis from one side of an imaginary plane containing the light emitting die, the optical axis being oriented perpendicular to this plane and emanating from a center of the die. Typically, the light generated by an LED is radiated within a hemisphere centered on the optical axis, with a majority of the light emitted at angles close to the optical axis of the LED. Although the quantity of light emitted typically declines as the angle relative to the optical axis of the LED increases, light emitted at angles greater than approximately 45° represents a significant portion of the overall light output of the LED. The distribution of light radiation within this hemisphere is determined by the shape and optical properties of the lens (if any) covering the light emitting die of the LED. Thus, LED's can be described as "directional" light sources, since all of the light they generate is emitted from one side of the device, with the other side dedicated to a support that provides electrical power to the LED and conducts heat away from the die.

When designing light sources for a particular purpose, it is important to maximize efficiency by ensuring that substantially all of the generated light is arranged in a pattern or field of illumination dictated by the end use of the device into which the light source is incorporated. The somewhat limited overall light output of individual LEDs frequently necessitates that several discrete LED components be cooperatively employed to meet a particular photometric requirement. Use of arrays of LEDs and their directional emission pattern present particular challenges to the designer of warning and signaling lights. Employing LEDs in compact arrays additionally imposes cooling, i.e., "heat sinking", requirements which may not be present in the case of prior art warning and signal light design.

SUMMARY

The present disclosure includes an optical assembly configured to produce an integrated light emission pattern relative to a first plane with limited spread in imaginary planes perpendicular to the first plane. For purposes of this application, light emitted from an LED can be described as "narrow angle" light emitted at an angle of less than about 45° from the optical axis and "wide angle" light emitted at an angle of more than about 45° from the optical axis $O_A$ as shown in FIG. 6. The initial trajectory of wide angle and narrow angle light may necessitate manipulation by different portions of a reflector and/or optical element to provide the desired illumination pattern.

In one disclosed embodiment, a plurality of LEDs are arranged on a support in a linear array, with the optical axes of the LEDs included in a first imaginary plane perpendicular to the support. An imaginary linear focal axis extends through the dies of the plurality of LEDs. Reflecting surfaces extend along either side of the array, forming a concave reflective trough. The reflective trough may be generally defined by a parabolic curve having a focus coincident with the linear focal axis and projected along said axis to form a linear parabolic structure on which reflecting surfaces can be arranged. An elongated lens is positioned above the LEDs and longitudinally bisected by the first imaginary plane. The elongated lens and trough are configured so that light may not be emitted from the optical assembly without passing through the elongated lens or being redirected by the trough reflector. The elongated lens is configured to redirect light emitted from the array of LEDs (and not incident upon the reflecting trough) from its emitted trajectory into imaginary planes parallel with the first plane. The reflective trough redirects wide angle light (light not passing through the elongated lens) from a range of emitted trajectories into a range of reflected trajectories closer to the first plane. The redirection performed by the elongated lens may be described as "partially collimated" or "collimated with respect to the first plane." Such partially collimated light retains the component of its emitted trajectory within the imaginary planes into which it is redirected, whereas fully collimated light is parallel with a line such as the optical axis of an LED.

In the disclosed embodiments, medial reflecting surfaces are also positioned between adjacent pairs of LEDs, to redirect a portion of the wide angle light from each LED into imaginary planes perpendicular to the first imaginary plane containing the optical axes of the LEDs. This subset of wide angle light from each LED is partially collimated with respect to an imaginary plane perpendicular to the first plane and including the optical axis of the respective LED. Light reflected from the medial reflecting surfaces retains the component of its emitted trajectory within the imaginary planes into which it is redirected, however this light must be further redirected by the elongated lens or trough reflector before being emitted from the optical assembly. Thus, the subset of wide angle light incident upon the medial reflectors may be fully collimated with respect to the respective LED optical axis before exiting the optical assembly, depending upon the specific configuration of the elongated lens and trough reflector.

The shape of the medial reflecting surfaces is dictated by their function, e.g., redirecting this subset of wide angle light into trajectories having a smaller angular component with respect to imaginary planes perpendicular to both the first plane (containing the optical axes of the LEDs) and a second plane containing the light emitting dies of the LEDs. These planes intersect at the linear focal axis of the assembly. It will be noted that the die of each LED typically includes a base that supports the light emitting die above a plane defined by a PC board upon which the LEDs are mounted. The imaginary second plane discussed in this application includes the LED dies and an imaginary linear focal axis passing through the LED dies. The medial reflecting surfaces may take many forms, but preferably comprise a convex surface when viewed looking toward the LED support (PC board). A preferred surface configuration for the medial reflecting surface partially collimates the subset of wide angle light incident upon the medial reflecting surfaces into imaginary planes substantially perpendicular to both the first plane containing the LED optical axes and the second plane passing through the LED dies. In the disclosed embodiments, the medial reflecting surfaces are defined by a segment of a parabola having a focus centered on the light emitting die of a respective LED. This parabolic segment is then rotated about the imaginary linear focal axis of the array to form a three dimensional surface. The medial reflecting surfaces on either side of a respective LED are mirror images of each other and adjacent medial reflecting surfaces meet at a semicircular peak. Other surface configurations approximating the intended function of the disclosed medial reflecting surfaces will occur to those skilled in the art. A semi-conical surface is an example of such an alternative configuration.

In the absence of the medial reflecting surfaces, the subset of wide angle light redirected by the medial reflecting surfaces would continue on its emitted trajectory and be lost (absorbed or scattered) within the assembly or be partially collimated by the trough reflector and elongated lens (into imaginary planes parallel with the first plane containing the LED optical axes). In either case, the retained component of the emitted trajectory of this subset of wide angle light (within the imaginary planes) means it cannot contribute to a majority of desirable light emission patterns and is effectively wasted.

The reflecting trough of the disclosed embodiment is constructed from a plurality of reflecting surfaces, some of which are surfaces of rotation centered on the optical axis of an LED and others are linear surfaces defined by a curve projected along the length of the trough. Each surface is selected to redirect light incident upon it into a range of trajectories that will contribute to a desired light emission pattern. The size and/or shape of each of the several reflecting surfaces may be adjusted to provide a desired light emission pattern.

It is known in the field of optics that reflecting surfaces may be formed as an internal reflecting surface or as polished or metalized external surfaces. Both types of surfaces are intended to be encompassed in the appended claims.

BRIEF DESCRIPTION OF THE DRAWINGS

Referring to the drawings, wherein like numerals refer to like elements in the several Figures.

DETAILED DESCRIPTION OF THE DISCLOSED EMBODIMENTS

Figure 1:
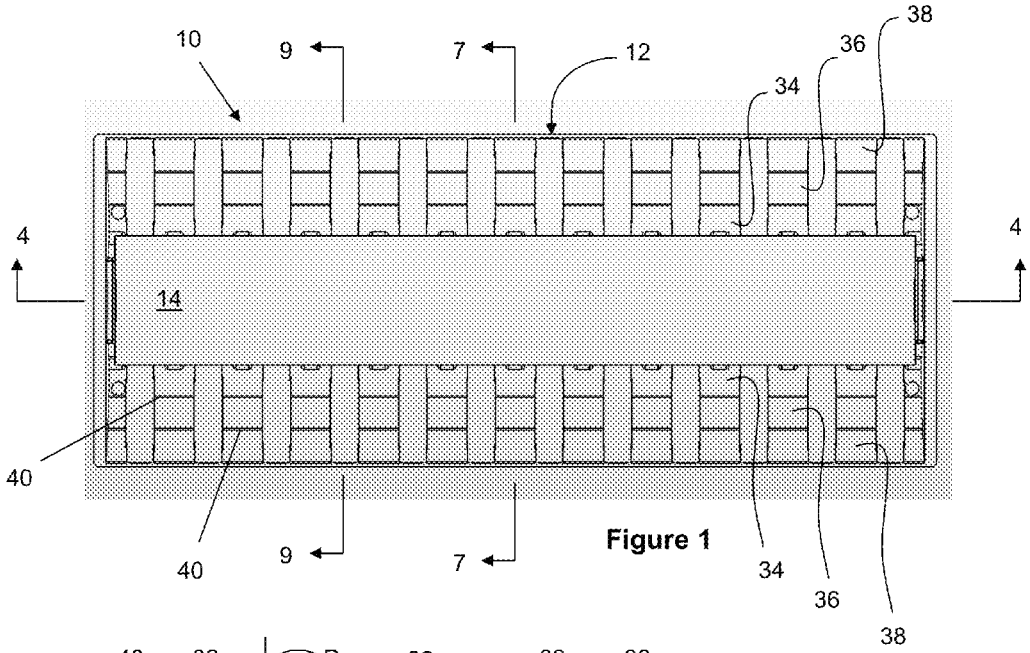
FIG. 1 is a front plan view of an optical assembly according to aspects of the disclosure.
Figure 2:
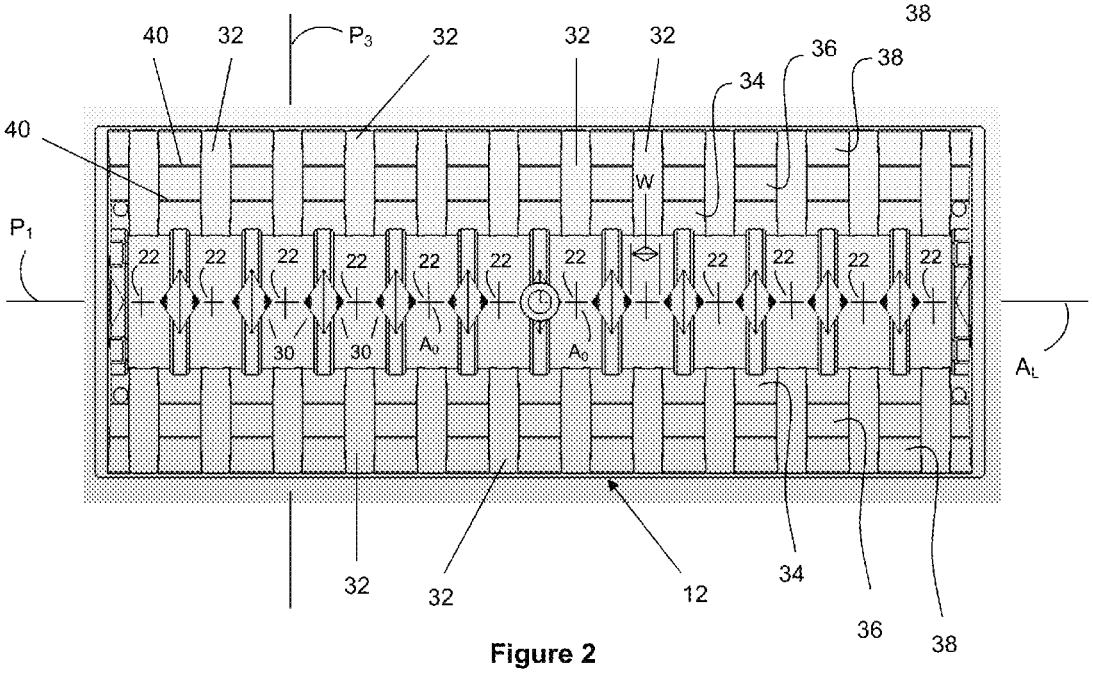
FIG. 2 shows the trough reflector of the optical assembly of FIG. 1 with the longitudinal lens of the optical assembly removed for clarity.
Figure 3:
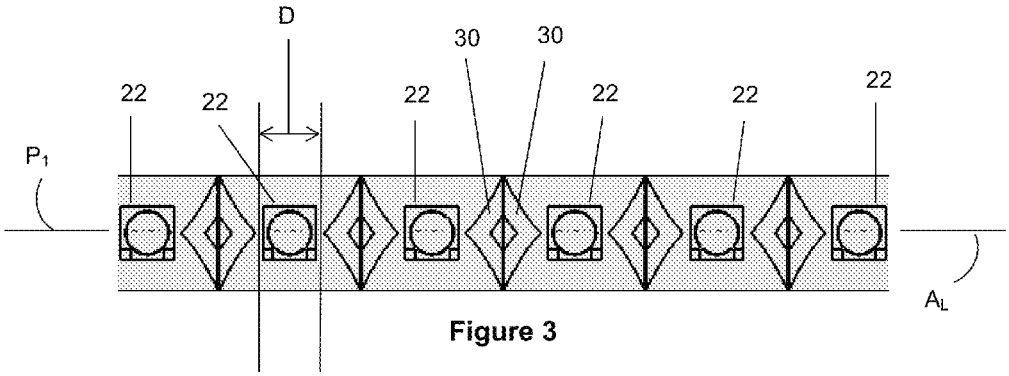
FIG. 3 is an enlarged partial front plan view of the reflector of the optical assembly of FIG. 1, showing LEDs in functional conjunction with the reflector medial reflecting surfaces.
Figure 4:
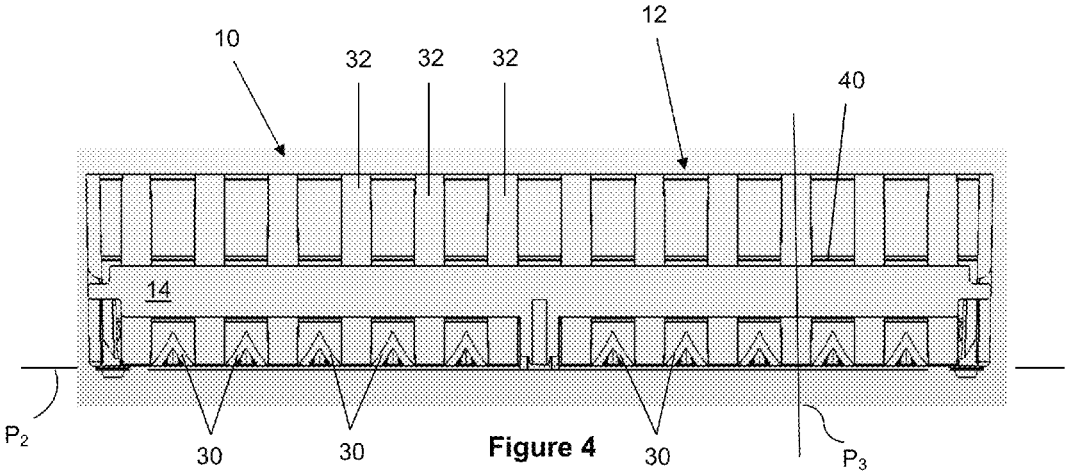
FIG. 4 is longitudinal sectional view of the optical assembly of FIG. 1, taken along line 4-4 thereof.
Figure 5:
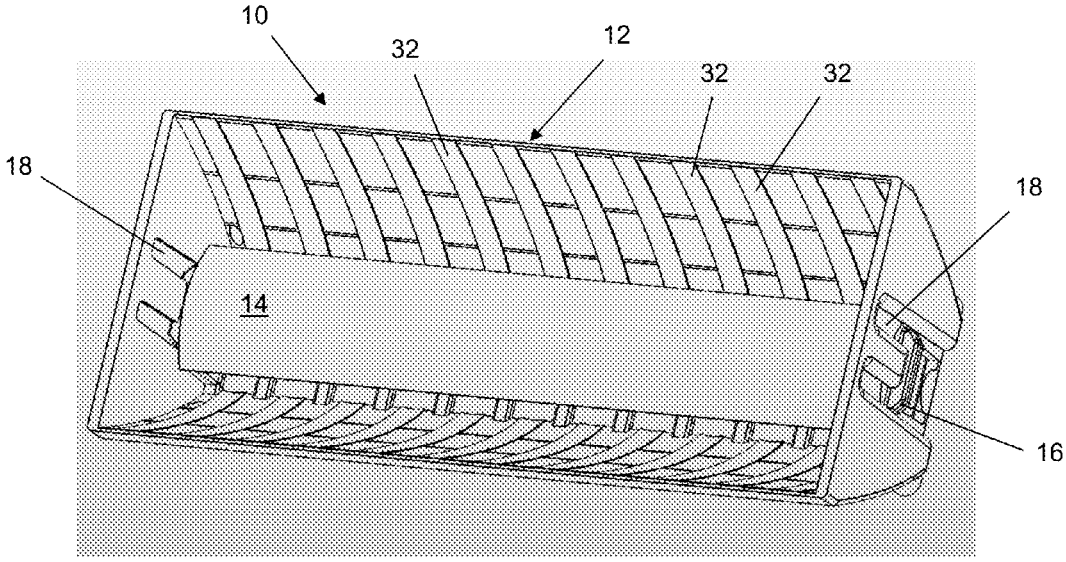
FIG. 5 is a front perspective view of the warning signal light of FIG. 1.
Figure 6:
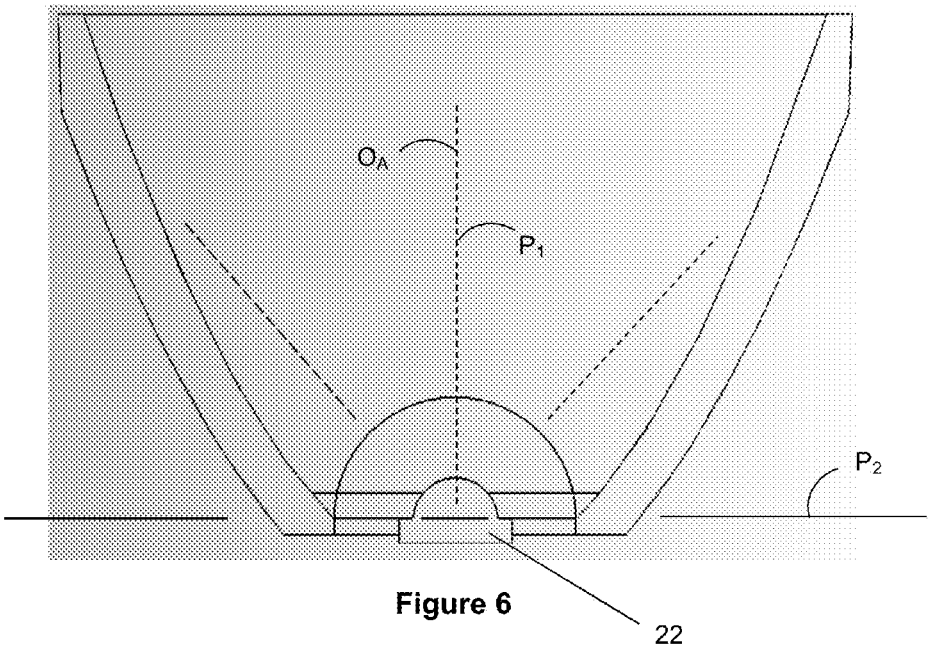
FIG. 6 is an enlarged sectional view through an alternative optical assembly used to illustrate light emission from an exemplary LED.
Figure 7:
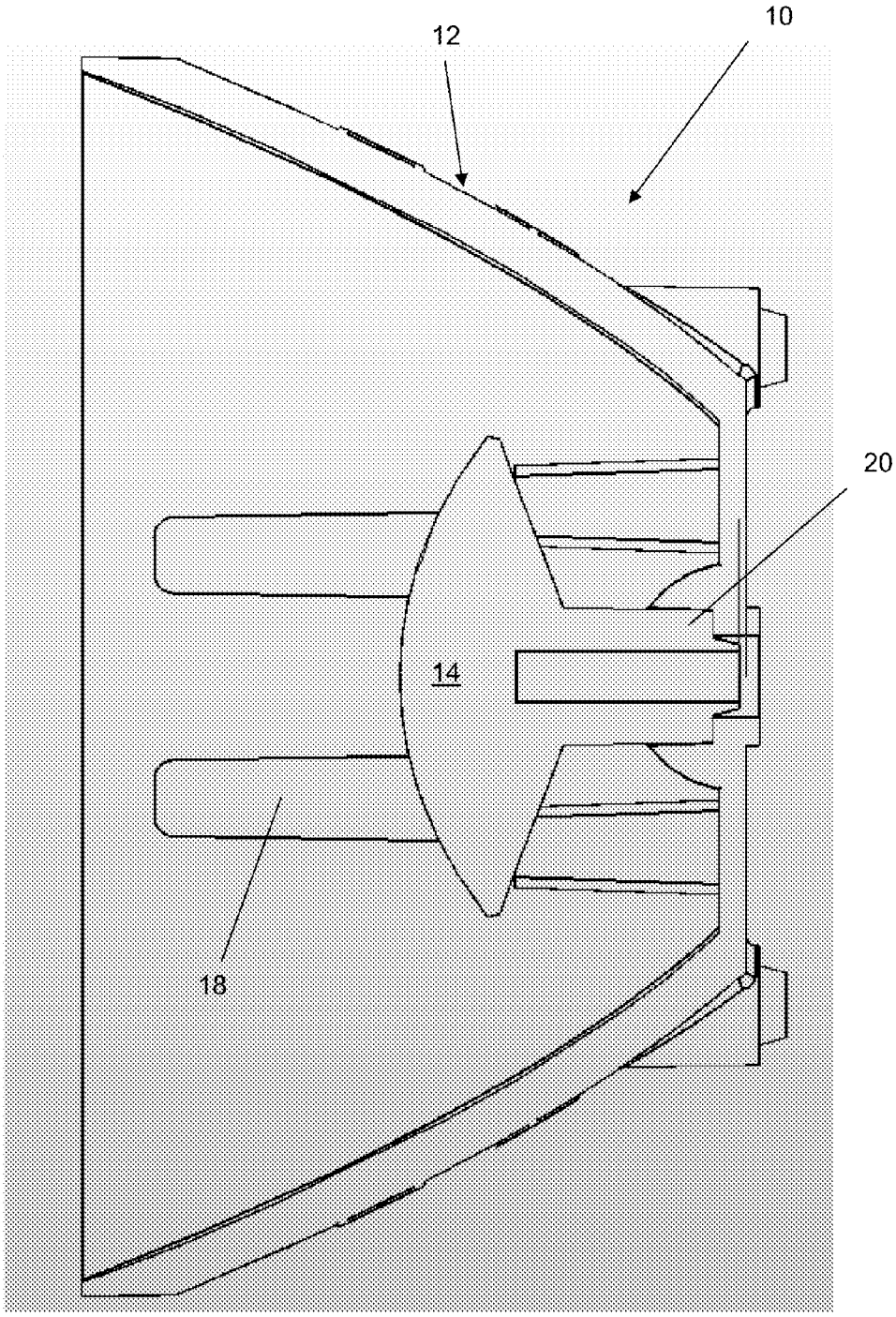
FIG. 7 is an enlarged sectional view through the LED optical assembly of FIG. 1, taken along line 7-7 thereof.

LED optical assemblies according to aspects of the present disclosure will now be described with reference to the figures, in which common reference numerals are used to designate similar components. FIGS. 1, 2, 4, 5, and 7-11 illustrate a first optical assembly according to aspects of the disclosure. FIGS. 3 and 6 are used to illustrate exemplary LED light emitters in functional conjunction with portions of an optical assembly. FIGS. 12-16 are diagrams used to illustrate a preferred geometry of the optical assembly according to aspects of the present disclosure. The disclosed LED optical assemblies are suitable for use in emergency vehicle warning lights, but the disclosed optical assemblies may be appropriate for use in other warning and signaling apparatus as well as general illumination applications.

Figure 8:
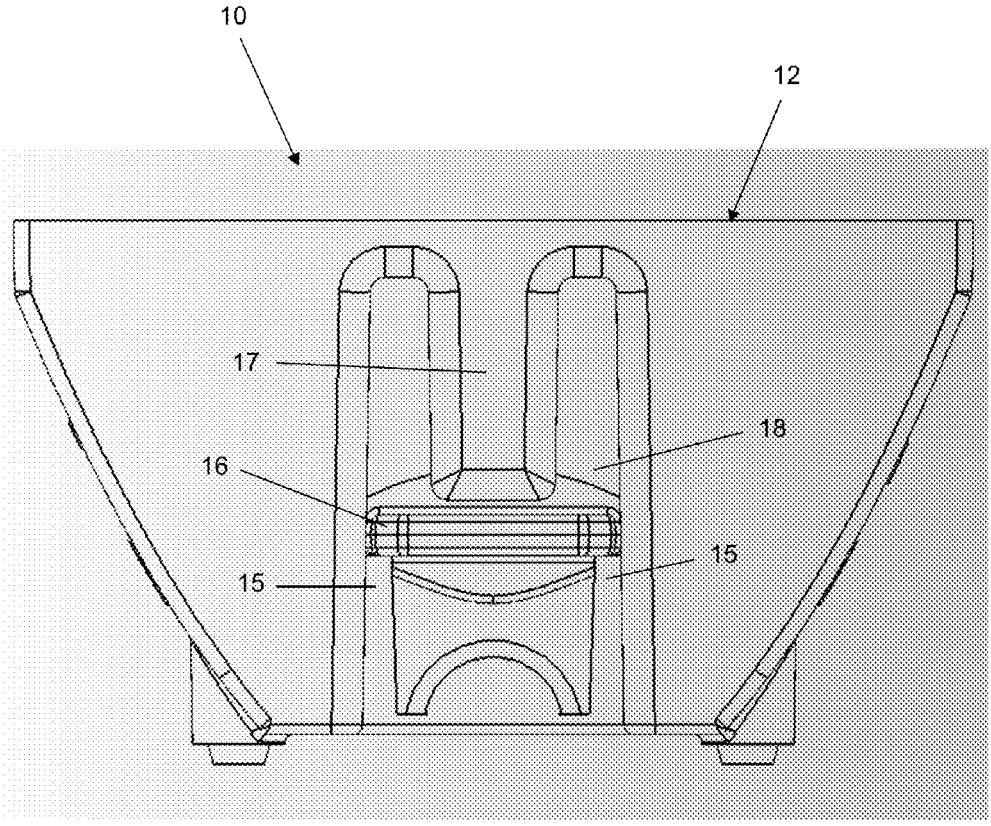
FIG. 8 is an enlarged left end view of the LED optical assembly of FIG. 1.
Figure 9:
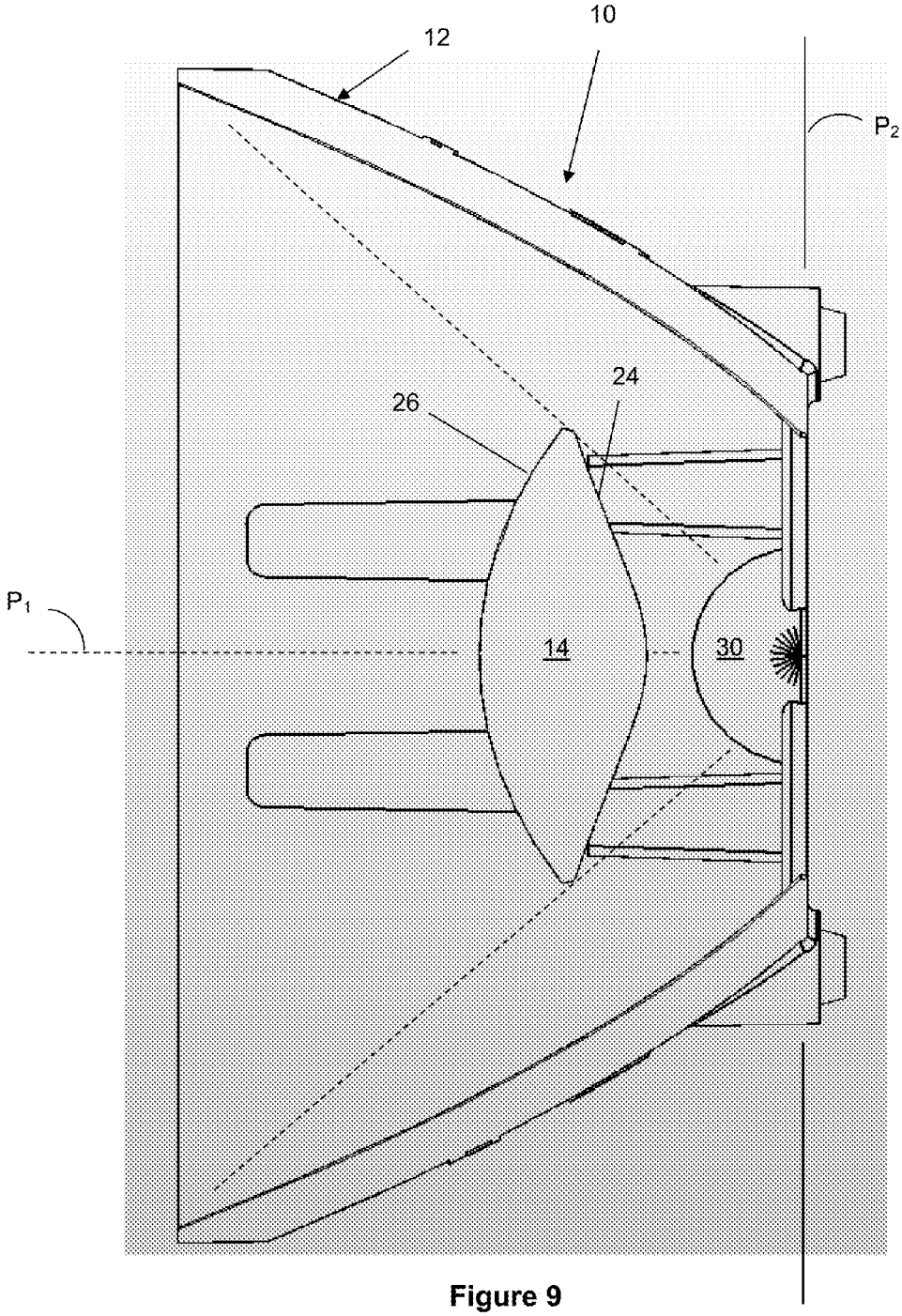
FIG. 9 is an enlarged sectional view of the optical assembly of FIG. 1, taken along line 9-9 thereof.
Figure 10:
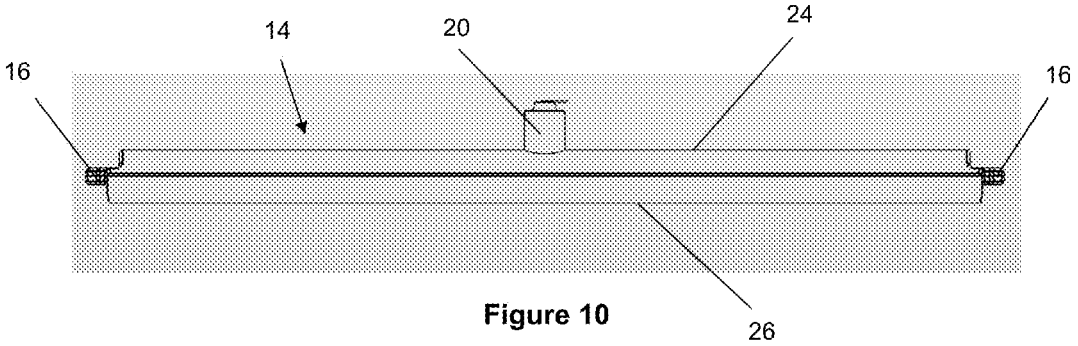
FIG. 10 is a side plan view of the longitudinal lens of the optical assembly of FIG. 1.
Figure 11:
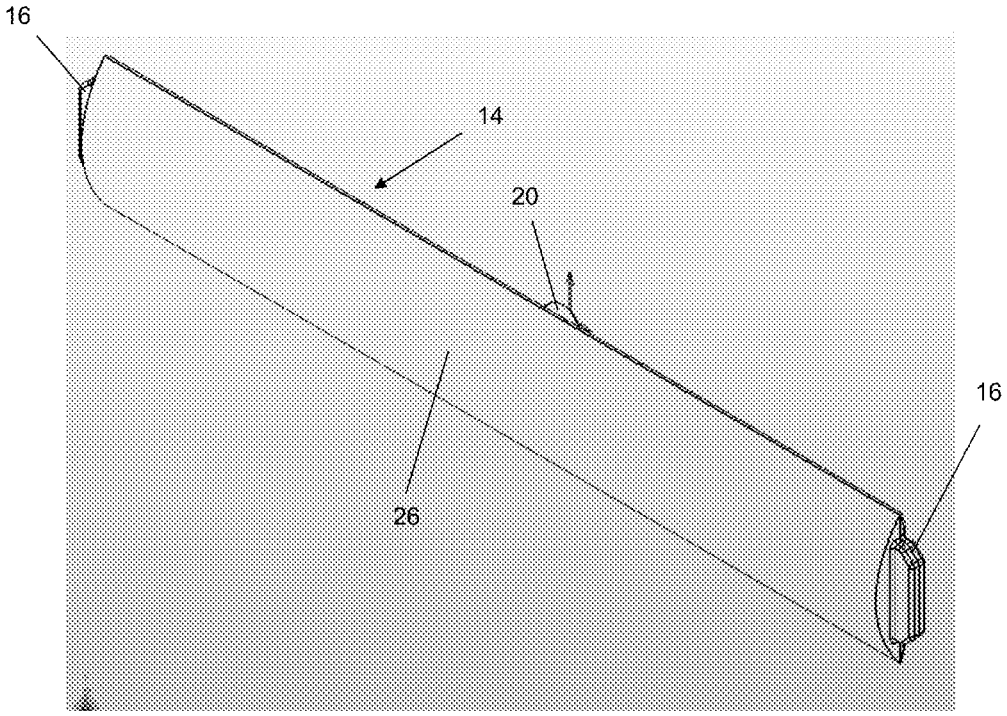
FIG. 11 is an enlarged perspective view of the longitudinal lens of the optical assembly of FIG. 1.

The disclosed optical assembly 10 includes a trough reflector 12 and a longitudinal lens 14. As shown in FIGS. 1, 4, 5, 7 and 9, the lens 14 extends the length of the trough reflector 12. Projections 16 at either end of the lens 14 fit into cradle openings 18 at either end of the reflector 12. As best seen in FIGS. 4, 5, and 7-9, the reflector 12 and lens 14 are configured to snap together, with the projections 16 of the longitudinal lens 14 received in the cradle openings 18. With reference to FIG. 8, each cradle opening 18 is partially bounded by a pair of shoulders 15 and a retention tab 17. As shown in FIGS. 4, 5, 8, 10 and 11, the projections 16 at the ends of the lens 14 have a configuration complementary to the shoulders 15 and tab 17. The projection 16 at one end of the lens 14 is inserted into a cradle opening 18 and advanced through the opening against the resilient movement of the tab 17. When one projection 16 of the lens 14 has moved through the cradle opening 18 sufficiently to permit the opposite projection 16 to enter the reflector trough 12, the lens 14 is pushed into the reflector trough until the projection 16 bears on the tab 17 at the opposite end, which flexes to permit the lens projections 16 to be seated in their respective cradle openings 18 and held in place by the tabs 17. The shoulders 15 support the lens from below, while the tabs 17 elastically retain the lens projections 15 in their respective cradle openings 18. The disclosed lens 14 also includes a fastener receptacle 20, which also functions as a standoff to maintain the central portion of the length of the longitudinal lens 14 in position above the array of LEDs 22. Securing the lens 14 at both ends and in the middle helps prevent the lens from bowing away from the intended straight position under the influence of changing environmental conditions (temperature). In the disclosed optical assembly 10, a fastener (not shown) extends through a heat sink and a PC board (not shown) to pull the reflector 12 and lens 14 into an installed position and maintain an efficient thermal contact between the PC board and the heat sink.

Figure 12:
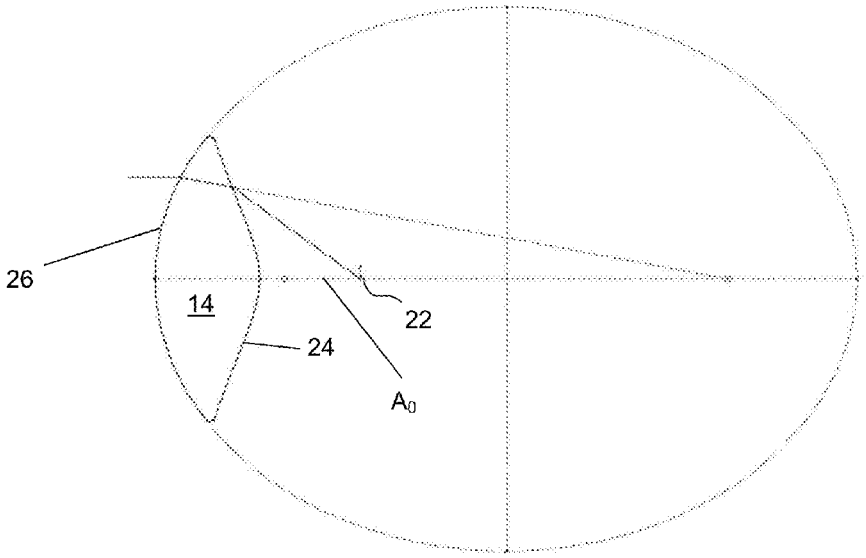
FIG. 12 is a diagrammatic sectional view of the longitudinal lens of the optical assembly of FIG. 1.

The lens 14 includes a convex light input surface 24 facing the LEDs and a convex light emission surface 26 facing away from the LEDs 22. The convex curves defining the light input surface 24 and light emission surface 26 are projected along the length of the lens 14, resulting in a substantially constant sectional configuration. The geometry of the lens 14 is illustrated in FIG. 12, which is a sectional view of the lens 14 in operational position relative to an LED light source 22. The lens 14 is configured to have a linear focus coincident with a linear focal axis $A_L$ passing through the dies of the plurality of LEDs 22 as shown in FIG. 2. Input surface 24 is defined by an aspheric curve calculated according to Fermat's Principal, using the distance from the LED 22 and the refractive index of the lens material. With the light input surface 24 configuration known, the light emitting surface 26 is calculated to result in light from the LED 22 passing through the lens 14 being collimated into rays parallel with the optical axis of the LED 22. The resulting light emitting surface 26 is defined by an elliptical curve as shown in FIG. 12. The upper and lower margins of the lens 14 are angled to permit light to pass above and below the lens 14 to be handled by the reflecting surfaces of the trough reflector 12. If the light from an LED is incident upon the light input surface 24, then it will be "partially collimated" into planes parallel with the optical axis $A_O$ and first plane $P_1$, but will retain the angular component of its emission within those planes. The divergent portions of this light will enhance light emission to either side of the center of the optical arrangement parallel with plane $P_1$. Other lens configurations will occur to those skilled in the art which will accomplish the function of partially collimating light from the LEDs and are compatible with the present disclosure.

The reflector 12 in the disclosed embodiments includes parallel, mirror image reflecting surfaces extending along each side of the array of LEDs 22. The function of the reflector is to redirect light originating from the LEDs 22 into a range of angles having trajectories close to planes parallel with plane $P_1$ which includes the optical axes $O_A$ of the LEDs 22. The trough reflector 12 is generally defined by a parabola 28 having a focus at the die of the LED 22. The shape of the reflector 12 is modified by superimposing surfaces defined by other curves onto the parabola 28 as will be discussed below. The disclosed trough reflector includes at least four distinct reflecting surfaces, each handling different portions of the light from the LEDs 22 and producing a portion of the resulting light emission pattern. Medial reflecting surfaces 30 are positioned to either side of each LED 22 and centered on the linear focal axis $A_L$. These surfaces are defined by portions of parabola 28 rotated about the linear focal axis $A_L$. The resulting surfaces of rotation redirect wide angle light from the LEDs 22 into planes such as $P_3$ perpendicular to both the first plane $P_1$ (containing the optical axes $A_O$ of the LEDs 22) and the second plane $P_2$ (containing the light emitting dies of the LEDs 22). Other non-parabolic surfaces, such as conical surfaces may be used for the medial reflecting surfaces 30 as will occur to those skilled in the art. Some of the light redirected by the medial reflecting surfaces 30 will subsequently pass through the lens 14, resulting in fully collimated light parallel with the optical axis $A_O$ of the LED 22. This fully collimated light reinforces the straight ahead or on axis peak light output from the optical assembly 10. Light redirected by the medial reflecting surfaces 30 and not passing through the lens 14 will be incident upon the reflector 14.

The trough reflector 12 has two mirror image parallel reflecting surfaces. Each of these surfaces includes three distinct reflecting portions. Rotated portions 32 extend from the bottom to the top of the trough in a direction parallel with plane $P_3$ as shown in FIG. 2. Rotated portions 32 are arranged in pairs on opposite sides of each LED 22. Each rotated portion 32 is defined by a segment of parabola 28 rotated about the optical axis $A_O$ of the LED 22 between the pair of rotated portions 32. Thus, each rotated portion 32 is a surface of rotation defined by a segment of a rotated parabola. Other curves rotated about the optical axis $A_O$ of the LED 22 may be compatible with the disclosed optical arrangement. This rotated surface configuration is designed to fully collimate divergent light incident upon it into a beam parallel with the optical axis $A_O$ of the respective LED 22. This light reinforces the on axis peak light output of the optical assembly 10. The width W of the parabolic portions 32 coincides with the distance D between the medial reflecting surfaces 30. Parabolic portions 32 separate concave linear reflecting surface portions 34, 36 and 38, which extend up the trough reflector 12 from bottom to top.

Figure 13:
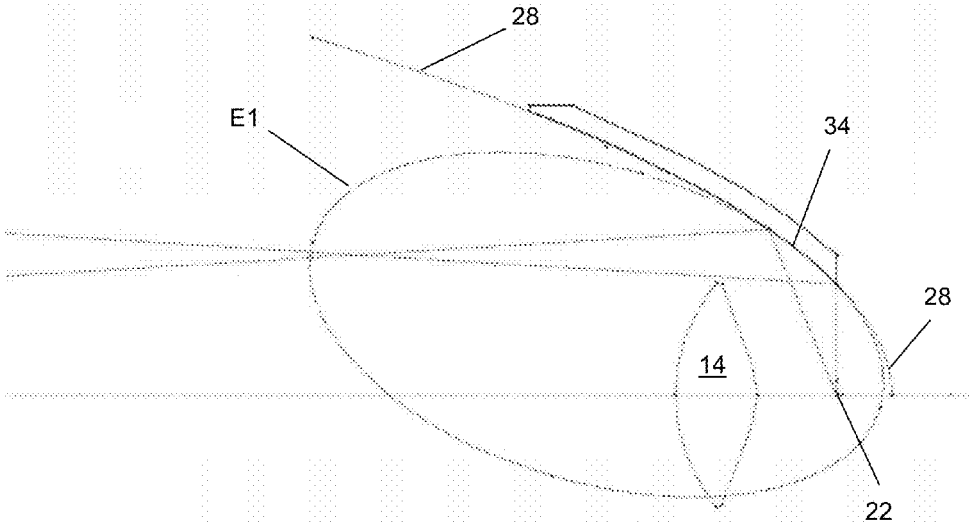
FIGS. 13-15 are a diagrammatic sectional view of the longitudinal lens and one half of the trough reflector of the optical assembly of FIG. 1.
Figure 14:
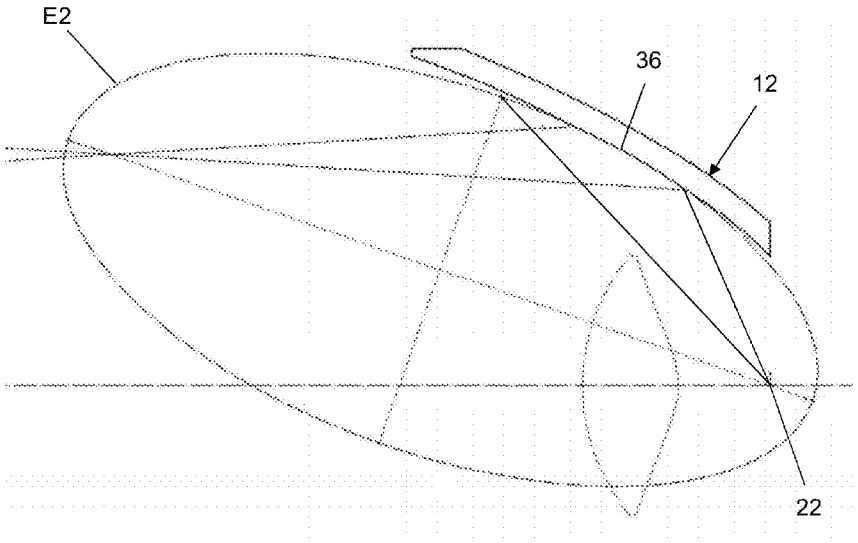
Figure 15:
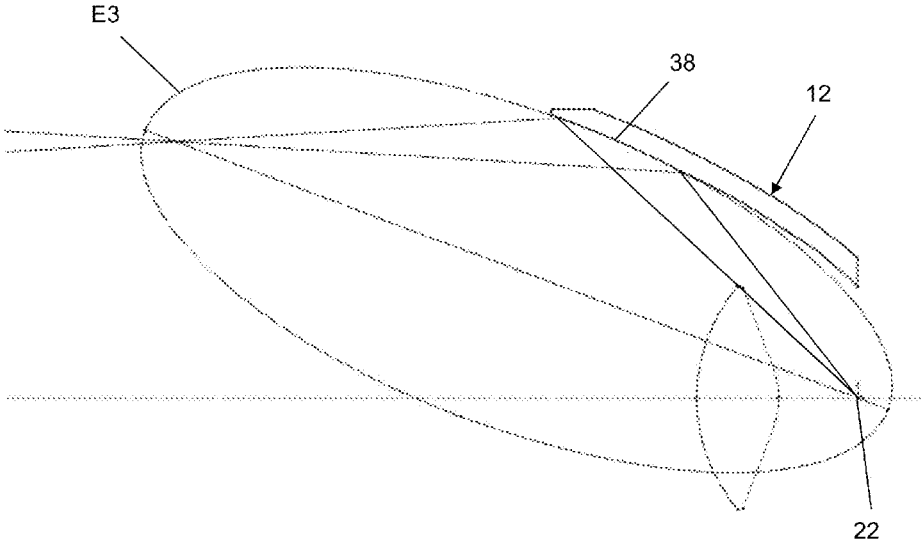

Each of the linear reflecting surface portions 34, 36 and 38 are defined by a segment of an ellipse projected along the linear focal axis $A_L$ of the optical arrangement 10. FIGS. 13-15 illustrate the geometry of the ellipses E1, E2 and E3, each of which has a first focus coincident with the light emitting die of the LED. Each ellipse E1, E2, and E3 is positioned to be coincident with the parabola 28 at the bottom of each respective linear portion 34, 36, 38. Each of FIGS. 13-15 illustrates representative light rays originating at the LED 22 and incident upon the lower and upper margins of each respective linear portion 34, 36, 38. These rays are redirected from by the respective linear portion into trajectories that converge at the second focus of the respective ellipse E1, E2, E3, resulting in an emission pattern having controlled vertical spread. While concave, elliptical surfaces are illustrated, other surface configurations are consistent with the disclosure.

As shown in FIGS. 2 and 6, the linear array of LEDs 22 extends between the reflecting surfaces of the reflector 12. Each LED 22 emits light in a hemisphere surrounding its respective optical axis $O_A$. Those skilled in the art will recognize that the emitted trajectory of some of the light from LEDs in the array will not reinforce a desirable light emission pattern for the assembly and is effectively wasted. In the disclosed warning light configuration, the light least likely to end up where it is useful is wide angle light emitted from each LED in a cone originating at the area of light emission (the LED die) and having a cone axis coincident with the linear focal axis $A_L$ of the assembly. There are two such cones of light for each LED in the assembly. Light incident upon the medial reflecting surfaces is emitted from the respective LED at an angle of at least 45° relative to the optical axis $O_A$ of the LED. The medial reflecting surfaces are positioned to redirect light having an emitted trajectory of less than approximately 40° from the linear focal axis $A_L$ of the LED array and at an emitted trajectory of greater than approximately 45° relative to the optical axis $O_A$ of each respective LED 22. It will be apparent that the cone of light is half a cone above the plane $P_2$.

The medial reflectors are configured to redirect this light into trajectories that will contribute to the overall light emission pattern. Generally speaking, such redirected trajectories are those closer to the optical axis $O_A$ of the respective LED 22 and/or further from the linear focal axis $A_L$ of the assembly. One disclosed configuration for the medial reflecting surface is defined by a parabolic curve having a focus at the area of LED light emission and rotated about the linear focal axis $A_L$. Light incident upon the medial reflecting surfaces 30 is redirected into planes $P_3$ perpendicular to both plane $P_2$ and the plane $P_1$ containing the optical axes $O_A$ of the LEDs 22. Light redirected by the medial reflecting surfaces 30 retains the component of its emitted trajectory within the planes $P_3$ until passing through the longitudinal lens 14 or being reflected by the trough reflector 12. Light that is first redirected by the medial reflecting surfaces and then by the longitudinal lens 14 is fully collimated (parallel) with respect to the optical axis of the respective LED 22. Thus light incident upon the medial reflecting surfaces 30 is incorporated into a desirable light emission pattern.

Those skilled in the art will recognize that a reflecting surface may be an external, polished or metalized surface or may be an internal surface of an optical solid, or so-called internal reflecting surface.

While exemplary embodiments have been set forth for purposes of illustration, the foregoing description is by way of illustration and not limitation. Accordingly, various modifications, adaptations and further alternatives may occur to one of skill in the art without the exercise of invention.

What is claimed is:

1. An LED optical assembly comprising:

a plurality of light emitting diodes (LEDs), each having an optical axis and a light emission pattern surrounding said optical axis, said plurality of LEDs being arranged in a linear array on a substantially planar support and provided with connections to electrical power, said linear array having a length and the optical axes of said plurality of LEDs included in a first plane perpendicular to said planar support;

a pair of longitudinal reflecting surfaces separated by said first plane and extending along opposite sides of said linear array, said longitudinal reflecting surfaces defining a trough having a generally parabolic sectional configuration and a linear focal axis passing through the light emitting dies of said LEDs, said trough including surfaces of rotation extending from a bottom edge to a top edge of each said reflecting surface and defined by a curve rotated about the optical axis of each said LED, said trough including linear reflecting portions defined by a curve projected along the linear focal axis, said linear reflecting portions alternating with said surfaces of rotation;

whereby light emitted from said at least one LED and incident upon said surfaces of rotation is redirected into trajectories parallel with the optical axis of said at least one LED and light incident upon said linear reflecting portions is redirected into trajectories at an angle of less than 20° divergence from said first plane.

2. The LED optical assembly of claim 1, comprising a pair of medial reflecting surfaces intermediate said longitudinal reflecting surfaces, said medial reflecting surfaces disposed on opposite longitudinal sides of at least one said LED and configured to redirect light originating at said at least one said LED and incident upon said medial reflecting surfaces into planes perpendicular to both said support and said first plane, a portion of the light redirected by said medial reflecting surfaces being redirected by said longitudinal reflecting surfaces.

3. The LED optical assembly of claim 1, wherein said longitudinal reflecting surfaces are mirror images of each other.

4. The LED optical assembly of claim 1, wherein said medial reflecting surfaces are mirror images of each other.

5. The LED optical assembly of claim 4, wherein light redirected by at least one of said medial reflecting surfaces and said longitudinal lens is collimated with respect to the optical axis of said at least one said LED.

6. The LED optical assembly of claim 4, wherein said longitudinal reflecting surfaces are defined by a trough reflector having ends configured to receive and retain respective longitudinal ends of said longitudinal lens.

7. The LED optical assembly of claim 1, comprising a longitudinal lens extending the length of said linear array and configured to redirect light from said plurality of LEDs into planes parallel with said first plane.

8. The LED optical assembly of claim 1, wherein said linear reflecting portions are defined by segments of elliptical curves having a first focus at an area of light emission of said at least one said LED.

9. The LED optical assembly of claim 1, wherein said linear reflecting portions comprise three linear reflecting portions, each said linear reflecting portion defined by a curve projected along said linear focal axis.

* * * * *